US010618853B2

(12) United States Patent
Willis

(10) Patent No.: US 10,618,853 B2
(45) Date of Patent: Apr. 14, 2020

(54) FUEL PROCUREMENT TOOL AND METHOD(S) OF USE

(71) Applicant: Chris D. Willis, Colorado Springs, CO (US)

(72) Inventor: Chris D. Willis, Colorado Springs, CO (US)

( * ) Notice: Subject to any disclaimer, the term of this patent is extended or adjusted under 35 U.S.C. 154(b) by 87 days.

(21) Appl. No.: 15/670,424

(22) Filed: Aug. 7, 2017

(65) Prior Publication Data

US 2018/0037518 A1 Feb. 8, 2018

Related U.S. Application Data

(60) Provisional application No. 62/372,058, filed on Aug. 8, 2016.

(51) Int. Cl.

| | |
|---|---|
| ***B25F 1/00*** | (2006.01) |
| ***B27L 11/00*** | (2006.01) |
| ***C06B 21/00*** | (2006.01) |
| ***B27L 7/06*** | (2006.01) |
| ***B26B 23/00*** | (2006.01) |
| ***B27G 19/00*** | (2006.01) |
| *B27L 7/00* | (2006.01) |
| *C10L 11/08* | (2006.01) |

(52) U.S. Cl.

CPC ..... *C06B 21/0083* (2013.01); *B25F 1/006* (2013.01); *B26B 23/00* (2013.01); *B27G 19/00* (2013.01); *B27L 7/06* (2013.01); *B27L 7/005* (2013.01); *C10L 11/08* (2013.01)

(58) Field of Classification Search

CPC ..... B25F 1/00; B27L 11/00; B27L 11/005; B27L 7/06

See application file for complete search history.

(56) References Cited

U.S. PATENT DOCUMENTS

| | | | | |
|---|---|---|---|---|
| 675,567 | A | 6/1901 | Levin | |
| 1,364,737 | A | 1/1921 | Dudley | |
| 3,200,861 | A | 8/1965 | Merz | |
| 9,403,261 | B2 * | 8/2016 | Weinberger | A47J 43/288 |
| 2007/0044322 | A1 * | 3/2007 | Trbovich, Jr. | B26B 3/00 30/294 |
| 2014/0127984 | A1 | 5/2014 | Smith | |
| 2014/0230253 | A1 * | 8/2014 | Ancsel | A47J 17/02 30/123.5 |
| 2014/0261892 | A1 | 9/2014 | Clarke | |

FOREIGN PATENT DOCUMENTS

| | | | | |
|---|---|---|---|---|
| CA | 2808003 | | 9/2014 | |
| CN | 204426928 | | 7/2015 | |
| EP | 0054169 | A1 * | 6/1982 | B27B 33/141 |
| EP | 0054169 | B1 * | 1/1985 | B27B 33/141 |

* cited by examiner

*Primary Examiner* — James C Goloboy
*Assistant Examiner* — Ming Cheung Po
(74) *Attorney, Agent, or Firm* — Leyendecker & Lemire, LLC

(57) ABSTRACT

A handheld tool configured to procure fuel is described. Embodiments of the fuel procurement tool include a handhold having a cutting mechanism located proximate one end of the handhold. Typically, the cutting mechanism can include at least one cutter link having a depth gauge, a top plate, and a gullet formed between the depth gauge and the top plate. The fuel procurement tool can be implemented to procure kindling from a piece of wood.

15 Claims, 10 Drawing Sheets

FUEL PROCUREMENT TOOL AND METHOD(S) OF USE

CROSS-REFERENCE TO RELATED APPLICATION

This application claims the benefit of U.S. Provisional Application No. 62/372,058, filed Aug. 8, 2016.

BACKGROUND

Starting a fire requires three basic necessities: fuel, oxygen, and an ignition source. Fuel can include wood, gasoline, petroleum based materials, etc. The ignition source can include flint, flame, concentrated sunlight, etc. When starting a fire via primitive means, well known procedures are typically followed to increase the probability of a successful fire start. Typically, burn piles are created starting from very fine fuel (e.g., tinder) with progressively larger pieces of fuel (e.g., kindling) in order to allow the fire to grow at a controlled rate in order to have enough oxygen and burnable fuel.

It is well known that the best way to start a fire in a survival situation, especially in wet climates and/or inclement weather, is to find a dry flammable material (e.g., tinder and/or kindling) to act as a base layer for the fire. Finding material for the base layer is imperative to getting a fire started when man made materials are not available for use. Wood can be added to the base layer to build the fire after the base layer has been prepared. As can be appreciated, the layer of kindling material is more easily ignited than larger sticks and logs, which will eventually be burned. Once the kindling begins to burn, larger sticks and logs can be added to the fire.

Hand tools used to cut wood include, but are not limited to, axes, adzes, chainsaws, splitting mauls, and splitting wedges used with a sledge hammer. Each type of hand tool has features that are useful for certain purposes, but each hand tool also has certain limitations. For instance, each of the mentioned hand tools are not typically carried around when exploring the outdoors due to the size, weight, and shape or functionality of the aforementioned hand tools. Further, each of the mentioned tools has a specific purpose, none of which include making tinder or kindling to help start a fire. Even further, none of the mentioned tools are designed to make tinder or kindling from wood found in wet climates or in inclement weather conditions.

A small and portable device adapted to manufacture different sized fuel in wet climates is needed.

DETAILED DESCRIPTION

Figure 1:
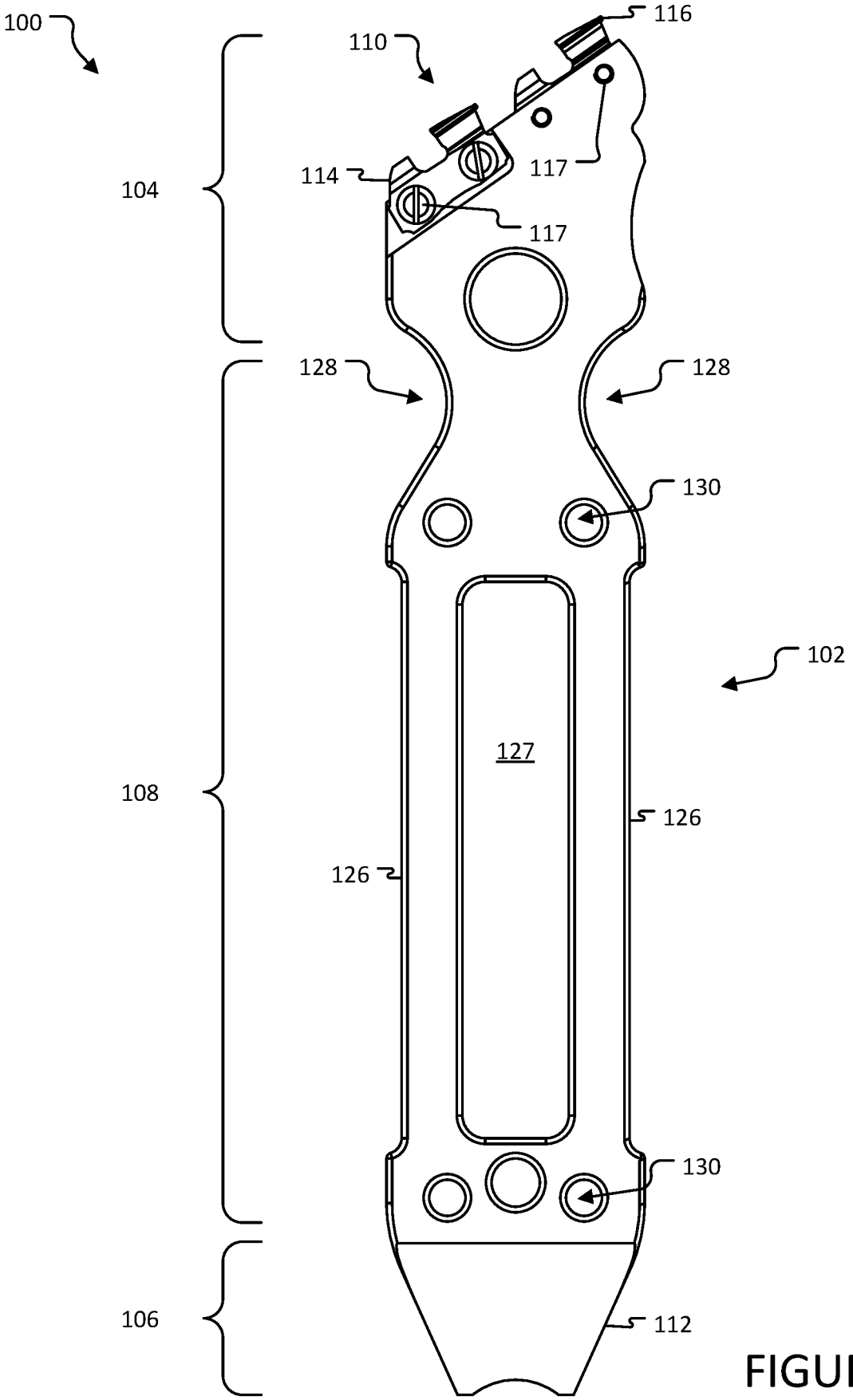
FIG. 1 is a front view of a fuel procurement tool according to one embodiment of the present invention.

Embodiments of the present invention include a fuel procurement tool and method(s) of use. Typically, the fuel procurement tool can be an all-purpose tool for creating different grades (or sizes) of fuel in a survival and/or outdoors situation. The fuel procurement tool can typically include, but is not limited to, a handhold and one or more chainsaw style cutter links coupled to, or integrated with, the handhold. Methods of implementing the fuel procurement tool can include scraping a tree branch along a grain of the tree branch with the cutter links of the fuel procurement device. As can be appreciated, as the cutter links are scraped against the branch along a grain of the branch, wood pieces appropriately sized for kindling and/or tinder can be cut from the branch. Typically, the pieces of wood can exit a gullet of the cutter link and be used to start a fire in a survival situation and/or in a typical fire start situation.

Typically, the handhold can be comprised of a rigid material. For instance, high quality steel alloys (e.g., 4140 alloy, 4142 alloy, and tool steel) can be implemented to manufacture the handhold. In another instance, titanium alloys can be implemented to manufacture the handhold. In some embodiments, the handhold can be anodized or powder coated. In one embodiment, the handhold can include a substantially rectangular aperture along a middle portion of the handhold. In one instance, the aperture can be implemented to provide a paracord tie off. As can be appreciated, various items can be stored in the aperture after being wrapped with paracord. For example, extra cutter links, flint, a magnesium block, a magnifying optic, a cylindrical tube containing personalized options for fire crafting, and matches may be stored in the paracord wrapped aperture.

Various means of attaching the cutter links to the handhold are contemplated. Removable and non-removable means for coupling the cutter links to the handhold can be implemented. In one instance, rivets can be used to couple the cutter links to the handhold providing a cheap but very strong cutting mechanism. Various types of screws and fasteners are contemplated including, but not limited to, hex, torx, phillips, slotted, etc. Of note, when fasteners or screws are implemented, the cutter links can be easily removed and replaced as needed. In some instances, an adhesive (e.g., LOCTITE®), nylon threaded, or similar method can be implemented to alleviate any inadvertent backing out of fasteners attaching the cutter links to the handhold.

One embodiment of the fuel procurement tool can include, but is not limited to, a plate implemented as a handhold, one or more chainsaw cutter links, a ferrocerium (or magnesium) scraper, a striker, a baton, a pry bar, and an aperture in the plate configured to receive a spindle.

One embodiment of the fuel procurement tool can include a shaft having at one end a cutting mechanism. The cutting mechanism can include components and a design similar to a cutter link commonly found on a chainsaw chain. The cutting mechanism can include a depth gauge, a top plate, and a gullet between the depth gauge and top plate. In one embodiment, the cutter links can be ⅜" pitch chainsaw cutter blades with 0.043 gauge. As can be appreciated, other sized cutter links and configurations are contemplated.

In one embodiment, the fuel procurement tool can include, but is not limited to, opposing chainsaw blades in tandem and parallel, the chainsaw blades coupled to a shaft, the shaft being coupled to a handle or other tool. When the blades are pulled and/or pushed with the grains of wood, as opposed to across the grains, thin strips of wood that can be used for kindling and/or tinder can be created. As can be appreciated, by implementing fasteners (e.g., screws) to couple the chainsaw blades to the shaft, the fuel procurement tool can be serviced in the field should a blade break, become worn, or become dull. Typically, the chainsaw blades can leave a channel in the wood as material is removed. The channel can be used for pulverizing the material that has been cut with any rough surface. In one instance, the channel can be a point of contact for prying and/or splintering smaller pieces of wood from the large piece of wood. In one embodiment, the fuel procurement tool can include a file portion integrated into a trailing head of the tool for pulverizing material.

One embodiment of the fuel procurement tool can include an integrated batoning edge for batoning wood either in half or into smaller pieces. For instance, the batoning edge can be a dull wedge implemented to split material into smaller parts. The batoning edge can further be implemented to scrape off wet bark for quicker access to inner wood.

Embodiments of the fuel procurement tool allow a user to procure one or more fuel sources in a broken down state from what would normally be an unusable and/or impractical fuel source. Fuel for the beginning stages of a fire may include very fine pulverized material (e.g., sawdust), shavings of minimal or variable size, small twigs (e.g., 1-2 mm in thickness), and pencil sized pieces of wood (e.g., approximately 10 mm in thickness). The typically unusable fuel source, for the beginning stages of a fire, can be broken down to facilitate one or more of the previously mentioned stages of fire construction by a combination of use including the cutter mechanism and pry bar tip.

As can be appreciated, the tool can be implemented to provide a much higher than typical probability of a successful fire start, even in extreme and/or wet conditions. The fuel procurement tool can accomplish this by accessing drier portions of the fuel source, breaking down the fuel source into useable sized portions, and breaking down the fuel source into sizeable pieces to facilitate efficient moisture dispersion with minimal heat sources. The fuel procurement tool can be implemented to create very fine kindling up thru larger kindling derived from a larger, unburnable fuel source for a beginning stage fire.

Kindling can refer to easily combustible material for starting a fire. Tinder can refer to an easily combustible material implemented to ignite fire by rudimentary means. For example, a shower of sparks may ignite tinder. One example of tinder may be a very flammable substance (e.g., petroleum soaked cotton ball) acceptable for use as kindling.

One embodiment of the fuel procurement tool can be implemented to procure tinder and/or kindling in extreme fire starting situations by efficiently procuring sources of otherwise unattainable drier wood from within wood in which the exterior of the wood holds a higher percentage of moisture than interior wood.

As can be appreciated, the fuel procurement tool can be implemented during survival situations as well as be implemented to start a recreational fire.

The cutting links of the tool can be scraped with or along a grain of wood to efficiently produce ideal sized pieces, essentially shavings and not sawdust, of wood capable of accepting minimal heat sources for the beginning stages of a fire. The scraping motion of the fuel procurement tool along the wood can be efficient, which may in turn allow by comparison large quantities of ideally shaped kindling and/or tinder procurement quickly and efficiently with comparably minimal effort as opposed to scraping with a knife, blade, etc. The size of the material procured by the fuel procurement tool may be ideal for moisture dispersion, flame promotion, heat acceptance, and oxygen saturation/airflow.

When starting a primitive, wilderness, survival, or situational fire, well known procedures are typically followed to increase the probability of a successful fire start. For instance, burn piles are typically created and organized starting from very fine fuel (e.g., tinder) with progressively larger pieces of fuel (e.g., kindling) in order to allow the fire to grow at a controlled rate in order to have sufficient oxygen and burnable fuel to eventually obtain a situational dependent sized fire. Of note, flammable tinder and/or kindling is one of the hardest things to procure from the wilderness due to inefficient methods and/or knowledge and/or experience. Not all organic compounds are flammable or some much less flammable than others. For instance, organic compounds containing excessive moisture and material in a state that is not conducive for promoting a flame to name a few. Non-conducive material can include, but is not limited to, large pieces of wood, wet wood, wood covered in bark which acts as a protective layer and holds in much of the moisture (regardless of wood size from very fine twig to full size tree), and wood that does not promote the flow of oxygen to flammable areas (e.g., lack of oxygen being the most common reason for fire crafters not promoting good flame). Embodiments of the present invention can include a cutting mechanism that may produce shavings of fuel that may form a "nest" of material that facilitates oxygen flow, fuel availability, and moisture dispersion.

As mentioned previously, sustained fire requires fuel (e.g., wood), a heat source (e.g., flint, ferrous steel, flame, concentrated sunlight, primitive methods, a battery combined with steel wool, petroleum jelly integrated into a cotton ball then provided with a minimal heat source, alcohol or alcohol prep pads from a first aid kit also promote a hot and sustainable flame), and oxygen. Fire is of the utmost priority second only to immediate shelter whether manmade or natural. Clothing may be considered the first line of shelter. As can be appreciated, fire can be used for hypothermia prevention, cooking food, purifying water, insect repellant, predator discouragement, signaling, morale booster and/or psychological booster (e.g., sense of safety, warmth, light, protection), a light source, and/or tool making.

Embodiments of the fuel procurement tool may also be implemented to drastically minimize caloric use and moisture loss. Energy conservation and time in survival situations may be a very relevant consideration. Moisture loss occurs from breathing and sweating, which can be exasperated when searching for fuel. In an emergency situation, loss of moisture from excessive breathing or sweating could be detrimental to survival. Hypothermic conditions can be increased by loss of sunlight which typically includes rapid temperature drop, exposure to elements, rapid temperature drops, rain and/or snow beginning, and/or thunderstorms.

Sweating (e.g., saturating clothing in perspiration) while gathering fuel sources could also lead to hypothermia as the outdoor temperature typically quickly reduces quickly after sunset. The loss of moisture can lead to dehydration which further complicates the situation as dehydration causes confusion, illness, and cramping.

As can be appreciated, if hypothermia is an imminent danger, the time required to procure fuel sources and/or obtain supplies for a fire becomes relevant. Hypothermia is a primary threat to outdoor survival situations and is considered a deadly threat after 3 hours on average (e.g., "rule of 3"—3 min air, 3 hours hypothermia, 3 days water, 3 weeks food). People in the final stages of hypothermia engage in "paradoxical undressing" because, as they lose rationality due to core temperature drop and their nerves are damaged, they feel incredibly, irrationally hot. They strip off their clothes to cool themselves down as they are freezing to death due to nerve damage. Once body temperature, by only a few degrees, begins to drop it is critical to maintain and/or recover lost body heat. Hypothermia happens quickly and is deadly.

The inability to function even if there are no freezing temperatures can happen if the wrong scenario is at hand. For example, in an unexpected rain storm 1-2 hours before nightfall where the victim became wet, unable to procure shelter and/or fuel for a fire due to a number of reasons such as injury. Even on a 40-50 degree night, hypothermia is relevant and a risk The fuel procurement tool can be implemented to reduce the time required to procure useable fuel for fire making. For instance, the fuel procurement tool can minimize the amount of time to search for a fuel source. Even logs of wood soaked with water can be used to procure usable kindling. As such, the fuel procurement tool can reduce the time to search for long periods (e.g., even 15-30 minutes) or reduce the distance needed to travel away from shelter for required items (e.g., resins, flammable bark, dry grass, etc). As can be appreciated, seeking material for a fire away from shelter in an already stressful, confusing, and potentially in shock or hypothermic situation could easily add unnecessary complications to survival.

Ideal fuel procurement can be accomplished by (i) accessing the drier portions of the fuel typically found towards the middle of sticks, limbs, logs (fallen or otherwise), downed or felled trees or limbs, as well as standing dead trees being an ideal source due to minimal ground contact and gravity pulling the water to the base of the tree as well as the bark providing a protective membrane, (ii) breaking down the fuel into organized, useable, burnable portions, (iii) breaking down the fuel into sizeable pieces to facilitate minimal heat sources and allowing a proper mixture of oxygen and burnable carbons, (iv) creating fine (kindling and/or tinder) thru larger kindling derived from a larger, initially unburnable for a beginning stage fire fuel source, and (iv) creating efficient moisture dispersion.

Terminology

The terms and phrases as indicated in quotation marks (" ") in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term "or" as used in this specification and the appended claims is not meant to be exclusive; rather the term is inclusive, meaning either or both.

References in the specification to "one embodiment", "an embodiment", "another embodiment, "a preferred embodiment", "an alternative embodiment", "one variation", "a variation" and similar phrases mean that a particular feature, structure, or characteristic described in connection with the embodiment or variation, is included in at least an embodiment or variation of the invention. The phrase "in one embodiment", "in one variation" or similar phrases, as used in various places in the specification, are not necessarily meant to refer to the same embodiment or the same variation.

The term "couple" or "coupled" as used in this specification and appended claims refers to an indirect or direct physical connection between the identified elements, components, or objects. Often the manner of the coupling will be related specifically to the manner in which the two coupled elements interact.

The term "directly coupled" or "coupled directly," as used in this specification and appended claims, refers to a physical connection between identified elements, components, or objects, in which no other element, component, or object resides between those identified as being directly coupled.

The term "approximately," as used in this specification and appended claims, refers to plus or minus 10% of the value given.

The term "about," as used in this specification and appended claims, refers to plus or minus 20% of the value given.

The terms "generally" and "substantially," as used in this specification and appended claims, mean mostly, or for the most part.

Directional and/or relationary terms such as, but not limited to, left, right, nadir, apex, top, bottom, vertical, horizontal, back, front and lateral are relative to each other and are dependent on the specific orientation of a applicable element or article, and are used accordingly to aid in the description of the various embodiments and are not necessarily intended to be construed as limiting.

The term "cutter link," as used in this specification and appended claims, refers to the link(s) on a chainsaw chain used to cut, including a left-hand cutter link and a right-hand cutter link.

A First Embodiment of a Fuel Procurement Tool

As shown generally in FIGS. 1-5, detailed diagrams of a first embodiment 100 of a handheld tool for procuring fuel is illustrated. The fuel procurement tool 100 can be implemented to procure one or more fuel types for a fire from one or more fuel sources. Fuel types can include, but are not limited to, tinder, kindling, twigs, branches, and/or splintered pieces of wood. Fuel sources can include, but are not limited to, wood, magnesium, ferrocerium, steel alloys, and/or steel.

Referring to FIG. 1, a front view of the fuel procurement tool 100 is illustrated. The fuel procurement tool 100 can include a handhold 102 having a first end 104, a second end 106, and a middle portion 108. The handhold 102 can be defined by a substantially rectangular shape having a thickness. In one embodiment, the handhold 102 can be manufactured from a single piece of rigid material. In another embodiment, the components of the handhold 102 can be manufactured independently and coupled together. Typically, the first end 104 can include a cutting mechanism 110 and the second end 106 can include a tapered end 112.

In one embodiment, the cutting mechanism 110 can include, but is not limited to, a first cutter link 114 and a second cutter link 116. Typically, the cutter links 114, 116 can be removably coupled to the first end 104 of the handhold 102. For instance, fasteners 117 can be implemented to couple the cutter links 114, 116 to the first end 104. As can be appreciated, the first end can include a plurality of threaded holes to receive the fasteners 117. In one embodiment, the cutter links 114, 116 can be a standard chainsaw cutter link. In one instance, the first cutter link 114 can be a left hand cutter link and the second cutter link 116 can be a right hand cutter link. In another instance, the first cutter link 114 can be a right hand cutter link and the second cutter link 116 can be a left hand cutter link.

Figure 7:
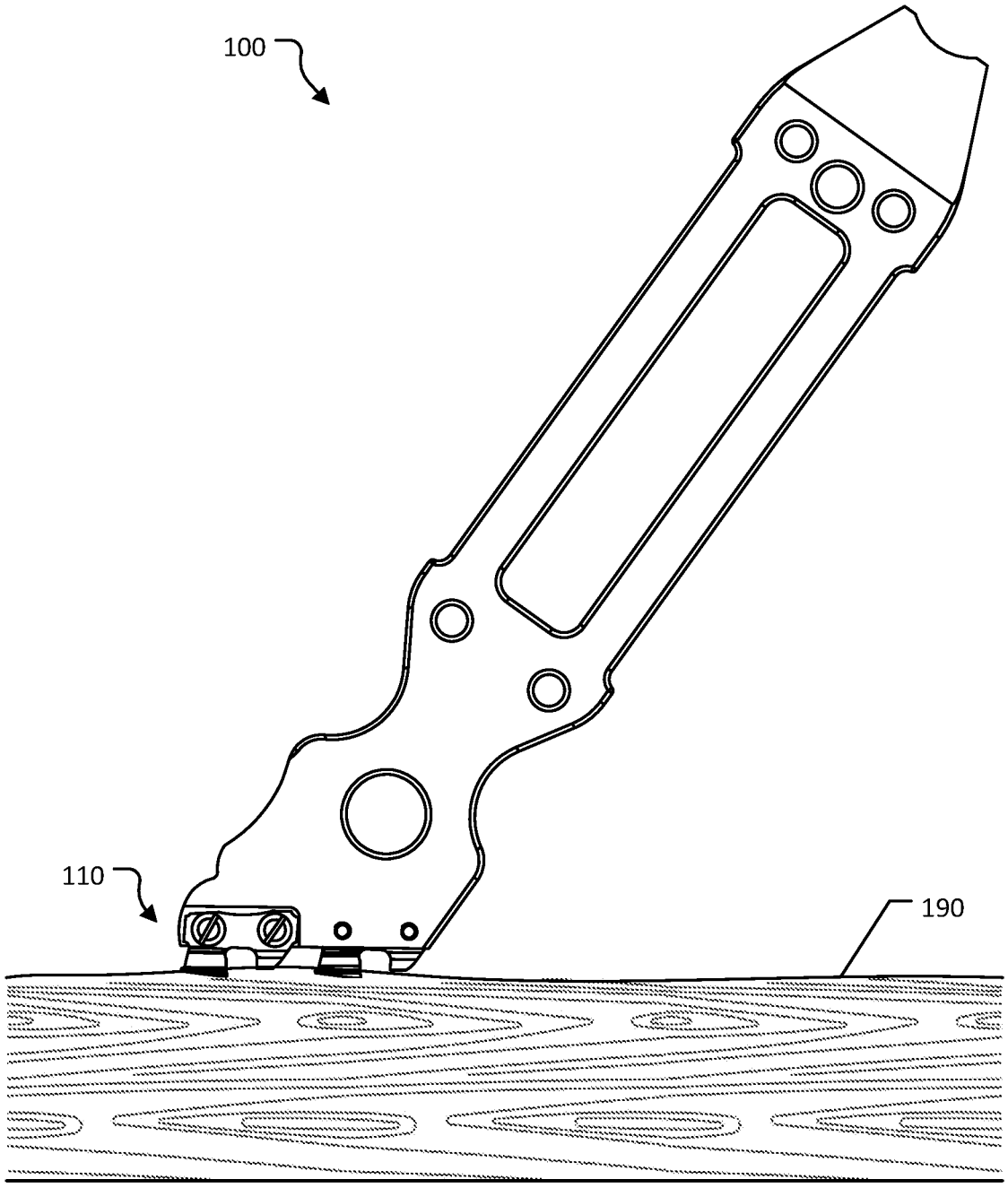
FIG. 7 is a back view of a fuel procurement tool according to one embodiment of the present invention.

As shown generally in FIGS. 1-5, the cutting mechanism 110 can be oriented at approximately 45 degrees from parallel with a latitudinal axis approximate the first end 104 of the handhold 102. Of note, a cutting portion (e.g., a top plate) of the first cutter link 114 can be canted down at approximately 45 degrees from parallel with the latitudinal axis of the first end. The second cutter link 116 can be oriented substantially similar to the first cutter link 114. As can be appreciated, when a user scrapes a piece of wood with the fuel procurement tool 100, the handhold 102 can be canted approximately 45 degrees from parallel (or perpendicular) with the piece of wood, as generally shown in FIG. 7.

Figure 2:
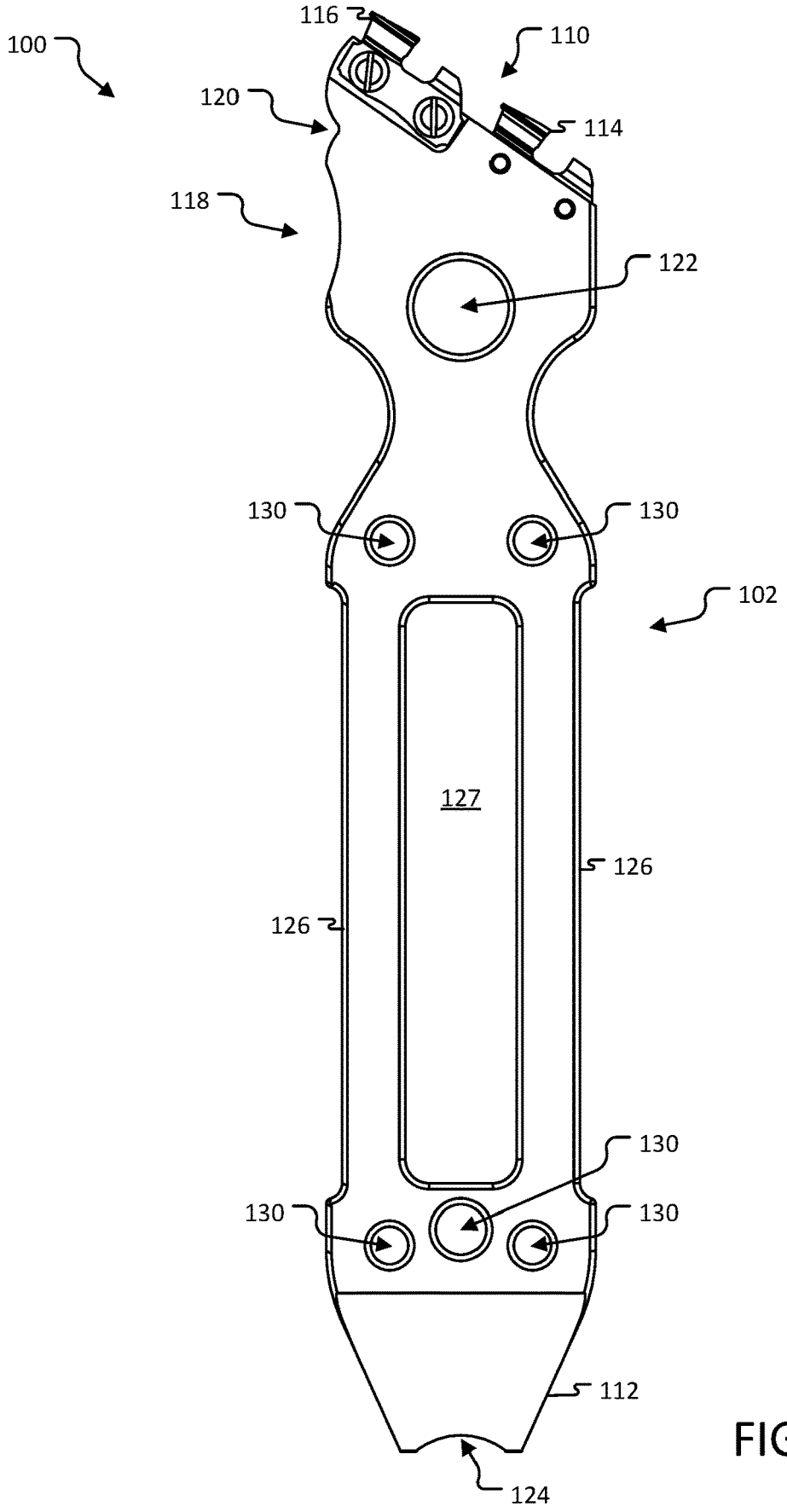
FIG. 2 is a back view of a fuel procurement tool according to one embodiment of the present invention.

Referring to FIG. 2, a back view of the fuel procurement tool 100 is illustrated. As shown, the first end 104 can further include a finger placement 118, a striker 120, and an aperture 122. The finger placement 118 can provide a point of contact for a user while the user implements the striker 120, or the finger placement 118 can act as an additional finger placement while implementing the first end 104. Typically, the striker 120 can be implemented to strike a piece of flint (or ferrocerium) to create a spark. The spark can be used to provide a heat source to start a fire in combination with fuels procured by the tool 100. In one embodiment, the striker 120 can be manufactured from a rigid material having a hardness of approximately 60 on the HRC Rockwell scale. For example, S7 shock-resisting tool steel can be implemented.

In one instance, the aperture 122 can be implemented to interact with a spindle when trying to start a fire by friction. As can be appreciated, one end of spindle may be inserted into the aperture 122, while the spindle may be spun creating friction and heat to start a fire. In another instance, the aperture 122 may be implemented to receive a piece of material for coupling the fuel procurement tool 100 to a bag or person. For example, the aperture 122 may receive a lanyard that can be attached to a person. In another example, the aperture 122 may be coupled to a carabiner which may then be attached to a bag, lanyard, or clothing of a user. In one instance, the aperture 122 can be implemented as a finger placement.

The tapered end 112 can be implemented for a variety of uses. In one instance, the tapered end 112 can be implemented as a pry bar to pry out larger sized kindling from channels created in a piece of wood by the cutting mechanism 110 for subsequent, progressive burn piles. In some instances, the pry bar 112 can be implemented (i) as a makeshift weapon, (ii) as a makeshift entrenching tool, (iii) to create a Dakota hole file (e.g., make a trench to facilitate oxygen to kindling or larger fire), (iv) as a flat blade screwdriver, (v) to drag perpendicular across bark to help break apart fibers, and (vi) to lightly scrape an outer edge of birch bark to gather "birch dust."

Figure 3:
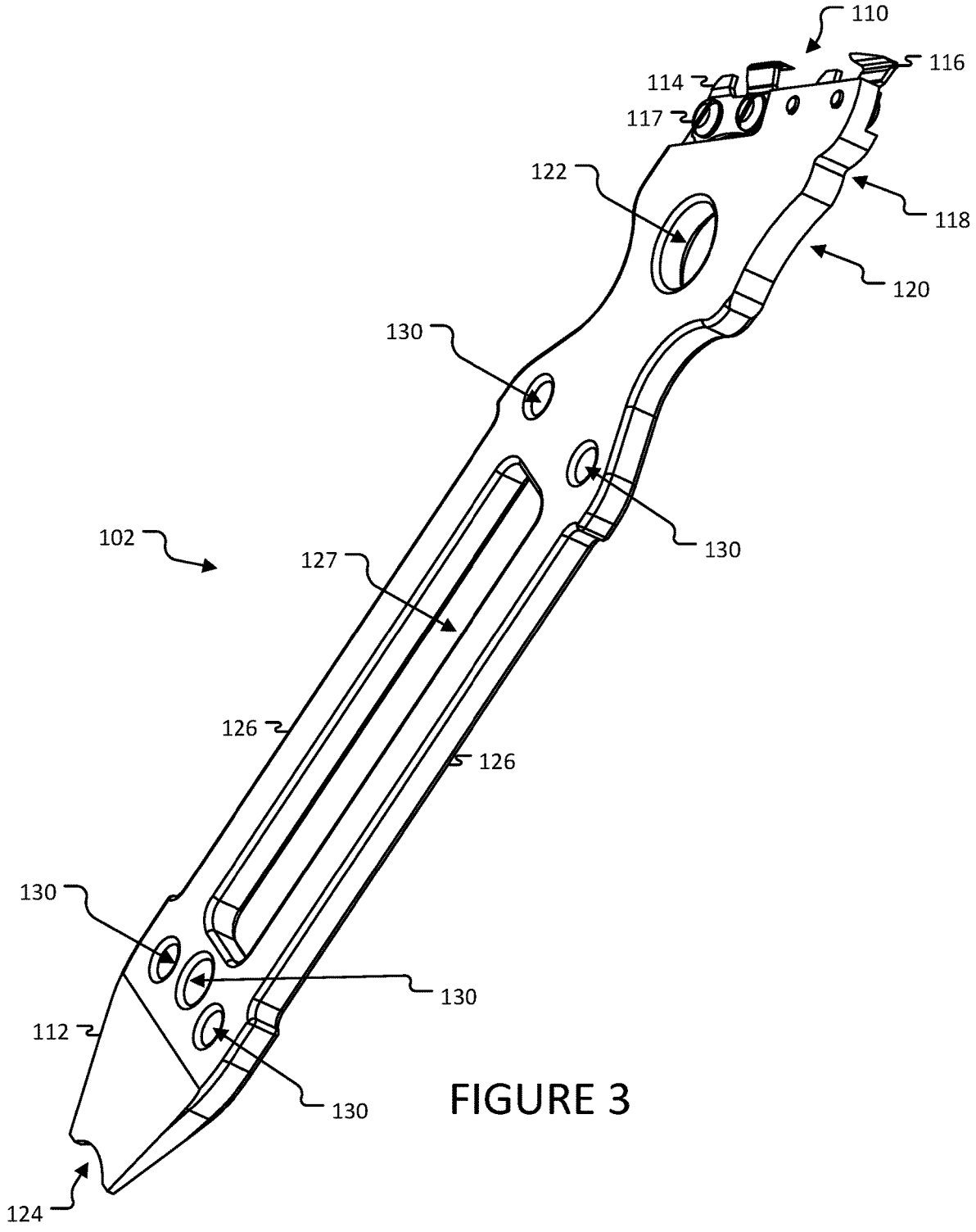
FIG. 3 is a front perspective view of a fuel procurement tool according to one embodiment of the present invention.
Figure 4:
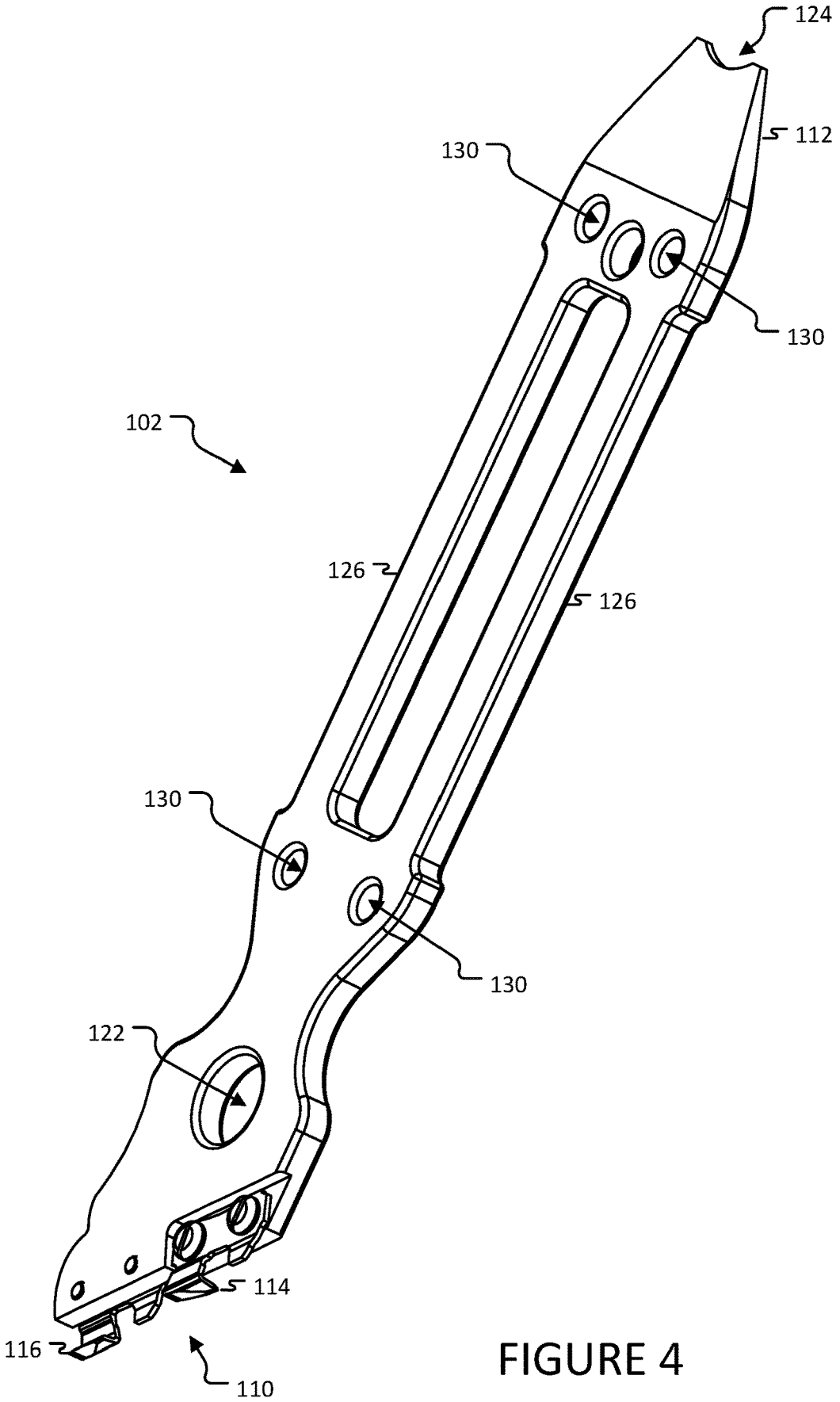
FIG. 4 is a back perspective view of a fuel procurement tool according to one embodiment of the present invention

As shown generally in FIGS. 1-4, a face 124 of the pry bar 112 can include a concave shape. Generally, a width and a thickness of the pry bar 112 can be tapered towards the face 124 of the pry bar 112. As shown in FIGS. 1-2, the pry bar 112 can taper down towards the face 124 of the pry bar. As generally shown in FIGS. 3-4, a thickness of the pry bar 112 can taper down towards the face 124. In one embodiment, the pry bar 112 can have squared off edges on the face 124 of the pry bar 112, where a bottom surface and a top surface of the pry bar 112 are equal in length. In another embodiment, the face 124 of the pry bar 112 can be canted approximately 5 degrees, with either the bottom surface or the top surface having a slightly longer length than the other surface. By canting the face 124 of the pry bar 112, ferrocerium rods can be shaved without the shavings igniting. As can be appreciated, a burn pile of ferrocerium shavings can be created and then ignited when ready to start a fire.

As previously mentioned, the concave face 124 of the pry bar 112 can be implemented to shave a fire starting rod. For instance, flint, ferrocerium, and/or magnesium rods may be shaved by the concave face 124. In one implementation, a user may place a fire starting rod within the concave face 124 of the fuel procurement tool 100 to cradle the rod as the rod may be scraped by the user. As can be appreciated, the concave face 124 can cradle the fire starting rod even when a user has shaky hands and cannot keep the fuel procurement tool 100 from shaking. A concentrated burn pile of shavings, or a larger scatter pattern, can be obtained for a prolonged, and more pronounced, heat source when the shavings are ignited.

As shown generally in FIGS. 1-4, the middle portion 108 of the handhold 102 can include a handle 126, a substantially rectangular aperture 127, a pair of hand (or finger) placements 128, and a plurality of apertures 130. In one embodiment, the handle 126 and the aperture 127 can be configured to interface with cordage (not shown) to allow the cordage to couple to the fuel procurement tool 100.

The pair of hand placements 128 can provide an ergonomic and ambidextrous surface for a user to hold onto the fuel procurement device 100 while using the cutting mechanism 110. By implementing a concave shape, the hand placements 128 can allow a user to securely hold the handhold 102 while vigorously scraping a piece of wood as well as provide a tactile feedback when implementing the cutting mechanism 110.

The plurality of apertures 130 can be implemented to reduce an overall weight of the fuel procurement tool 100 while maintaining structural integrity. As can be appreciated, the plurality of apertures 130 may be implemented similarly to the spindle aperture 122 for interfacing with a spindle and/or for coupling the tool 100 to a bag, person, piece of clothing, or lanyard.

Figure 5:
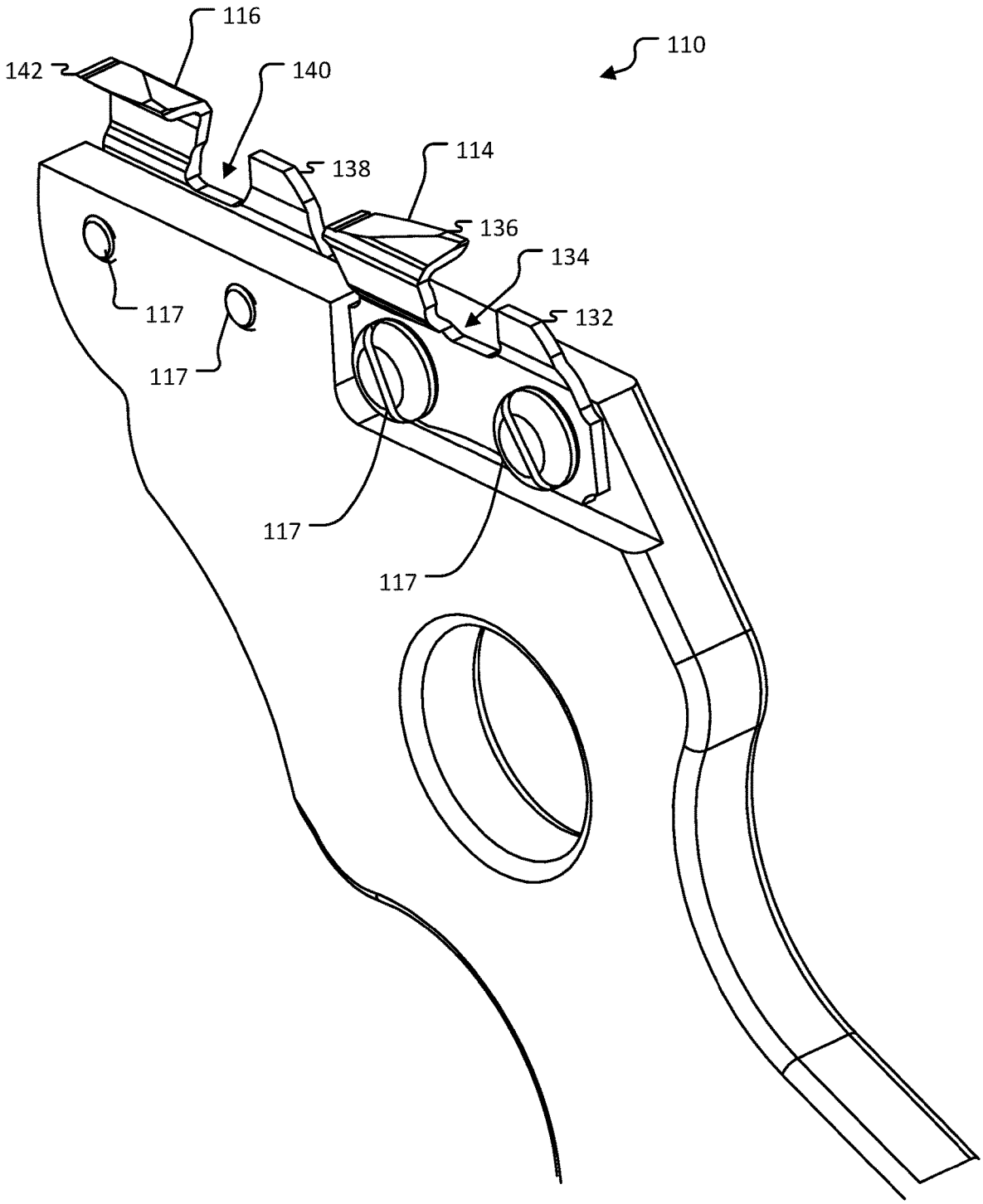
FIG. 5 is a close-up view of a cutting mechanism according to one embodiment of the present invention.

Referring to FIG. 5, a close-up view of the cutting mechanism 110 is illustrated. As previously mentioned, the cutting mechanism 110 can include the first cutter link 114 and the second cutter link 116. In one embodiment, the first cutter link 114 can include, but is not limited to, a depth gauge 132, a gullet 134, and a top plate 136. As shown, the gullet 134 can be formed between the depth gauge 132 and the top plate 136, similar to a cutter link found on a chainsaw chain. Of note, the second cutter link 116 can be similarly configured to the first cutter link 114. For instance, the second cutter link 116 can include a depth gauge 138, a gullet 140, and a top plate 142. In a typical implementation, the cutter link 114, 116 can be removably coupled to the handhold 102. For instance, the fasteners 117 can be implemented to removably couple the cutter links 114, 116 to the handhold 102.

Figure 6:
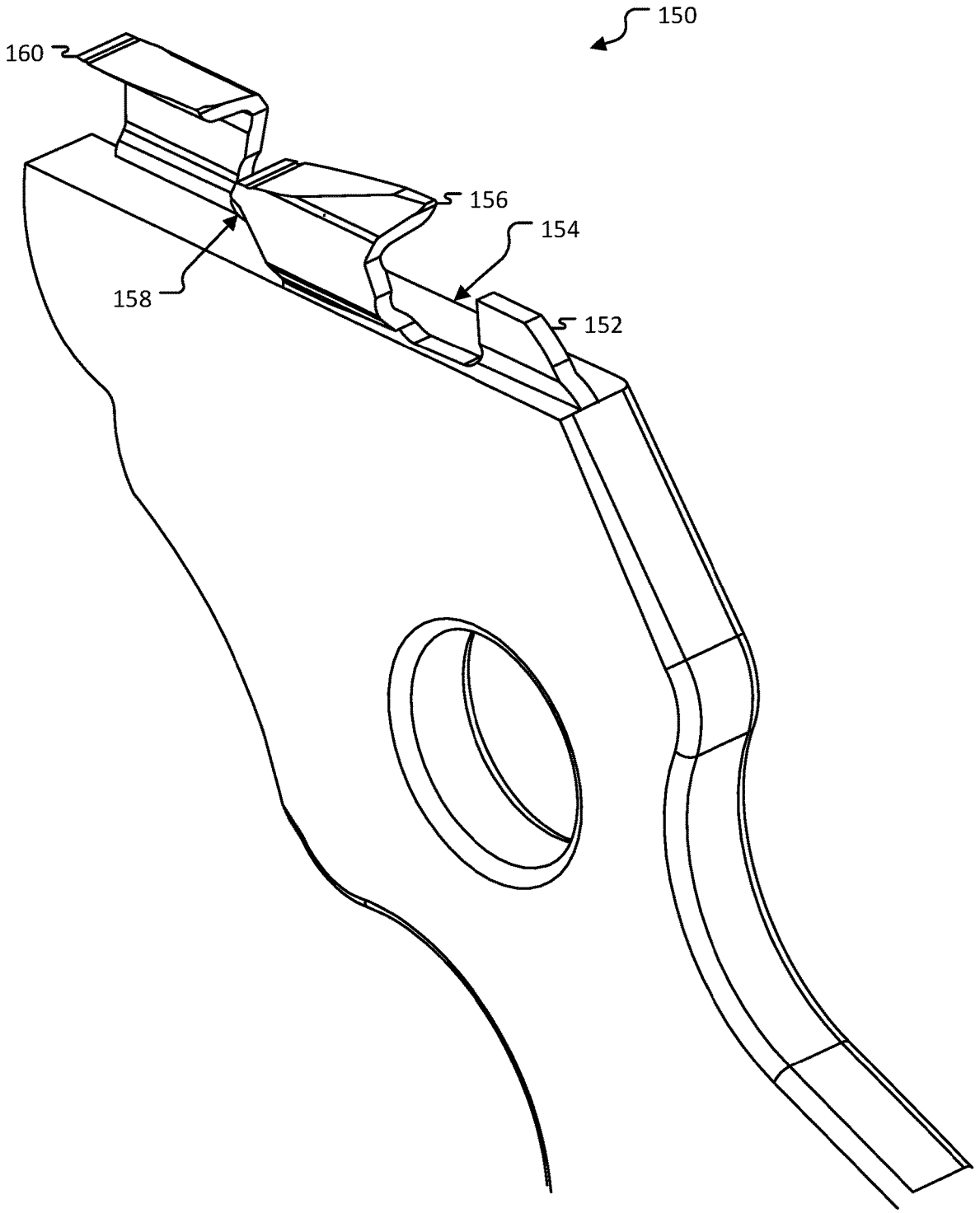
FIG. 6 is a close-up view of another cutting mechanism according to one embodiment of the present invention.

Referring to FIG. 6, a second embodiment of a cutting mechanism 150 is illustrated. In one embodiment, the second embodiment of the cutting mechanism 150 can be an integral part of the handhold 102. For instance, the cutting mechanism 150 may be forged from the same piece of material as the handhold 102. In another instance, the cutting mechanism 150 may be cast from the same mold as the handhold 102. In yet another instance, the cutting mechanism 150 may be formed from a pair of cutter links, with a depth gauge removed from one of the cutter links. Typically, the second embodiment cutting mechanism 150 can include, but is not limited to, a depth gauge 152, a first gullet 154, a first top plate 156, a second gullet 158, and a second top plate 160. The first gullet 154 can be formed between the depth gauge 152 and the first top plate 156. The second gullet 158 can be formed between the first top plate 156 and the second top plate 160. As shown, the first top plate 156 can be oriented opposite of the second top plate 160. For instance, the first top plate 156 can be similar to a left-hand cutter link and the second top plate 160 can be similar to a right-hand cutter link. Of note, the orientation of the first top plate 156 and the second top plate 160 can be switched.

The first gullet 154 and the second gullet 158 can be implemented to allow strips of wood to exit from the cutting mechanism 150 as the cutting mechanism 150 may be scraped along a piece of wood.

A Method of Implementing a Fuel Procurement Tool

As previously mentioned, the fuel procurement tool 100 can be implemented to procure kindling from a piece of wood. Of significant note, the fuel procurement tool 100 can be implemented to procure fuel from a soaked piece of wood in a survival situation.

In a typical implementation, a user may first find a piece of wood. After finding an appropriate piece of wood, the user may then start scraping the piece of wood with the cutting mechanism 110 of the fuel procurement tool 100. In some instances, the user may first remove any bark from a portion of the piece of wood before scraping along a grain of the wood with the cutting mechanism 110. As the user scrapes the piece of wood, the cutting mechanism 110 may create small thin strips of wood that may be implemented as kindling. The user may continuously scrape the piece of wood until a sufficient amount of kindling has been procured from the piece of wood. In instances where the wood may be soaked with moisture, the user may discard any soaked wood until dry parts of the piece of wood are reached or attempt to disperse moisture with the ignition source.

As shown generally in FIG. 7, the fuel procurement tool 100 can be oriented at an approximate angle of 45 degrees in relation to a piece of wood 190. With the tool 100 oriented at approximately 45 degrees, the cutting portions of the cutting mechanism 110 can be substantially parallel with a longitudinal axis of the piece of wood 190. In a typical implementation, the cutting mechanism 110 can be scraped along a grain of wood. As can be appreciated, as the cutting mechanism 110 is scraped along the grain, thin strips of wood can be cut from the piece of wood and be implemented as tinder and/or kindling for starting a fire. Of note, the cutting mechanism 110 may create channels in the piece of wood 190 as strips of wood are removed.

In one example implementation, the fuel procurement tool 100 can be used to procure kindling from a piece of soaked wood having bark. First, the pry bar 112 end of the tool 100 can be used to scrape away bark from a desired area on a piece of wood. After the bark has been scraped off, the cutting mechanism 110 of the tool 100 can be used to cut channels into the piece of wood for procuring kindling. In some instances, the pry bar can be implemented to retrieve larger kindling as channels are created for the different stages of the fire burn pile. The fuel procurement tool 100 can be used to remove material towards a center of the piece of wood where the likelihood of dry wood, or drier wood, is most probable. Where tinder may be needed to help facilitate a spark, kindling left in the created channels can be worked with a file, on a trailing end (as shown in FIGS. 8C-8D) of the cutting mechanism 110, into tinder. In another instance, tinder can be formed by moving the cutting mechanism 110 back and forth with very little pressure. Of note, the channels can subsequently be used to aid in the transportation of oxygen to the kindling and/or tinder.

After the kindling and/or tinder have been procured, the pry bar 112 can be implemented to separate the channels and break the piece of wood apart to create appropriately sized sticks for the burn pile. In some instances, a batoning edge (described hereinafter and shown in FIGS. 8A-8B) can be implemented to break medium sized pieces of wood into smaller pieces.

Second Embodiment of a Fuel Procurement Tool

Figure 8A:
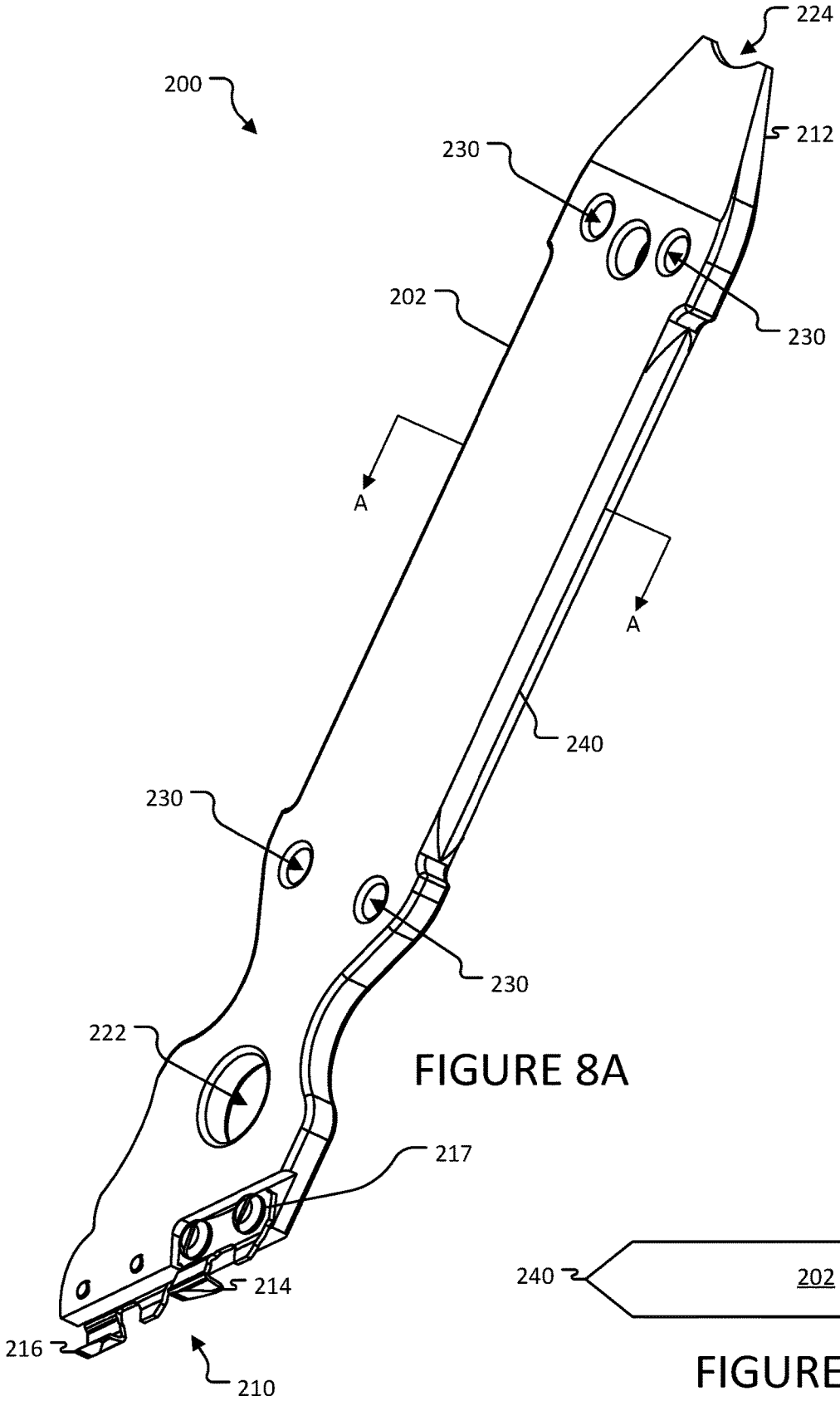
FIG. 8A is a back perspective view of a fuel procurement tool showing cross-section line A-A according to one embodiment of the present invention.

Referring to FIG. 8A, a second embodiment 200 of a handheld tool for procuring fuel is illustrated. The second embodiment fuel procurement tool 200 can include components substantially similar to the first embodiment fuel procurement tool 100. For instance, the fuel procurement tool 200 can include a handhold 202, a cutting mechanism 210, and a tapered end 212. The cutting mechanism 210 can include a first cutter link 214 and a second cutter link 216. The tapered end 212 can include a face 224 having a concave shape. The handhold 202 can include an aperture 222 for interacting with a spindle when trying to start a fire by friction. In some instances, the fuel procurement tool 200 can include a plurality of apertures 230 providing weight reduction and means for attaching the fuel procurement tool 200 to a person or pack. In one instance, the plurality of apertures 230 can be implemented to secure a handle to the fuel procurement tool 200.

Figure 8B:
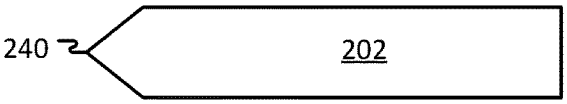
FIG. 8B is a cross-section view taken along line A-A in FIG. 8A of the fuel procurement tool according to one embodiment of the present invention.
Figure 8C:
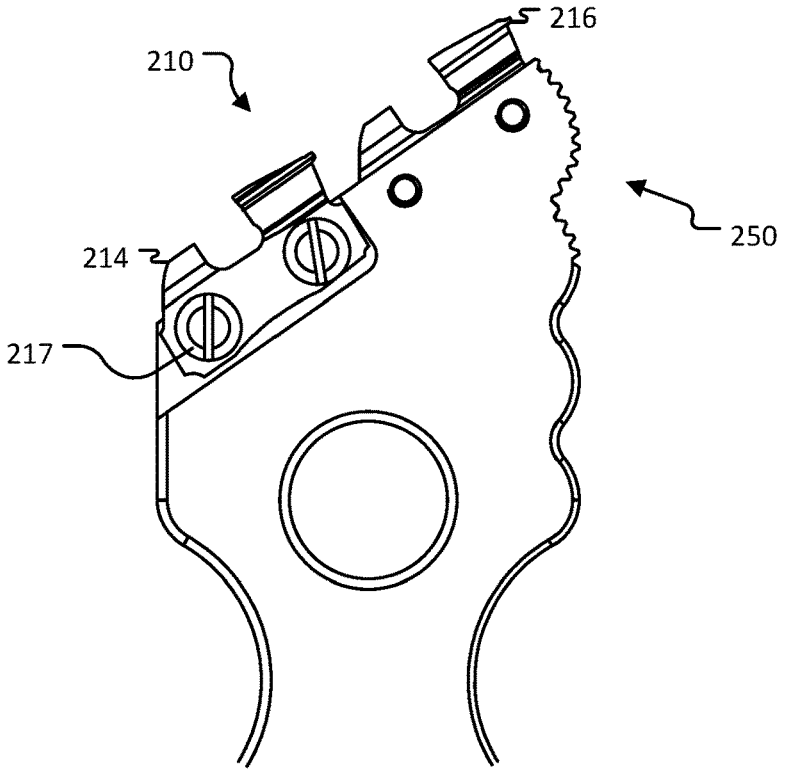
FIG. 8C is a front view of a fuel procurement tool according to one embodiment of the present invention.
Figure 8D:
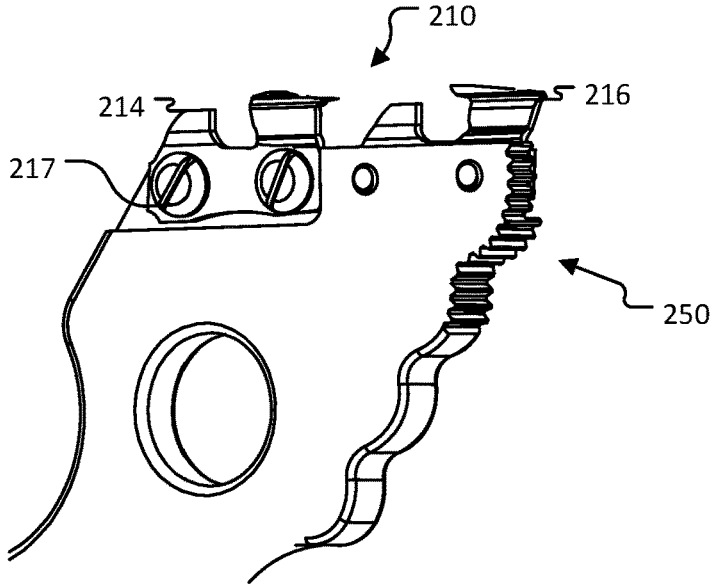
FIG. 8D is a front perspective view of a fuel procurement tool according to one embodiment of the present invention.

Referring to FIG. 8B, a cross-sectional view of the handhold 202 is illustrated. As shown generally in FIGS. 8A-8B, one side of the handhold 202 can include a tapered edge 240 forming a wedge. In one instance, the tapered edge 240 can be implemented for batoning. For example, the tapered edge 240 can be implemented to split wood in half and/or into smaller pieces. In a typical implementation, the tapered edge 240 can be placed in contact with a piece of wood and then hit with another piece of wood or other rigid member to drive the tapered edge 240 into the wood. As can be appreciated, the piece of wood can be split or broken down with the tapered edge 240. In another instance, the tapered edge 240 can be implemented to scrape bark off of a piece of wood. As can be appreciated, there are a plurality of uses the tapered edge 240 may be implemented to do.

Referring to FIG. 8C, a close-up view of the cutting mechanism 210 end of the second embodiment fuel procurement tool 200 is illustrated. Referring to FIG. 8D, a perspective close-up view of the cutting mechanism 210 end of the second embodiment fuel procurement tool 200 is illustrated. As generally shown, the cutting mechanism 210 end can include a multi-ridged edge 250 having a surface substantially similar to a file tool. The file edge 250 can typically have a rounded shape for pulverizing small pieces of wood into tinder. For instance, the file edge 250 can be implemented to pulverize strips of wood left in channels from a piece of wood scraped with the cutting mechanism 210. In one embodiment, the file edge 250 can be located at a trailing end of the second cutter link 216. In one example, the file edge 250 can include an approximately 135 degree turn leading to the handhold 202. As can be appreciated, implementing the trailing end of the cutting mechanism 210 is an acceptable method for pulverizing kindling within a channel created by the cutting mechanism 210. In some instances, the file edge 250 may be implemented to strike a ferrocerium rod or similar rod for creating a spark. In some instances, the file edge 250 can be implemented to produce magnesium shavings from a magnesium block.

Third Embodiment of a Fuel Procurement Tool

Figure 9:
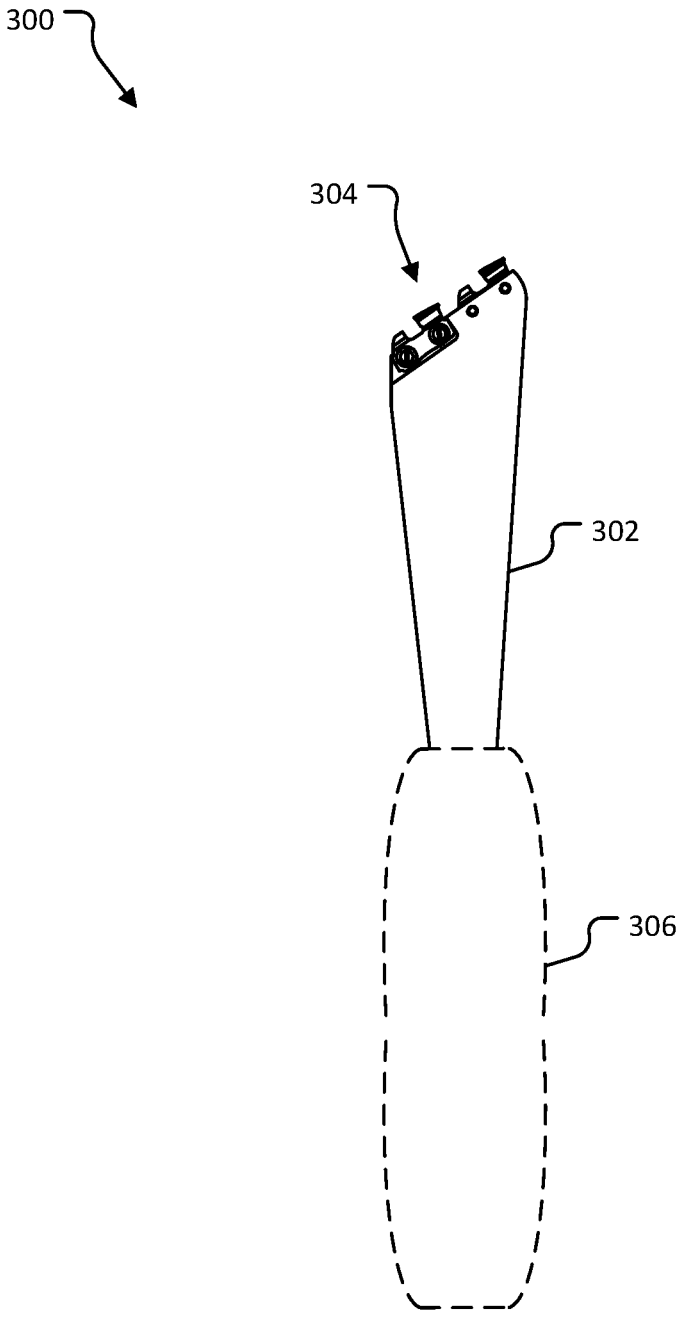
FIG. 9 is a front view of a fuel procurement tool according to one embodiment of the present invention.

Referring to FIG. 9, a third embodiment 300 of a handheld tool for procuring fuel is illustrated. The third embodiment fuel procurement tool 300 can include a shaft 302 and a cutting mechanism 304. Typically, the shaft 302 can be attached to a handle 306. The handle 306 can include, but is not limited to, a standalone handle, a multi-tool, a multi-purpose tool, etc. For instance, the shaft 302 may include a tang and be coupled to a handle and be implemented as a standalone tool. In another instance, the shaft 302 may be coupled to a multi-tool having a plurality of different tools. For example, the shaft 302 can be configured to couple to a LEATHERMAN® multi-tool or a SWISS ARMY® multi-purpose knife. In another example, the shaft 302 can be configured to couple to a multi-purpose knife. For instance, the shaft 302 may be rotatably coupled to a handle of the multi-purpose knife such that the cutting mechanism 304 may be rotated out when needed.

In one embodiment, the cutting mechanism 304 can be constructed substantially similar to the first embodiment cutting mechanism 110 including removable cutter links. In another embodiment, the cutting mechanism 304 can be substantially similar to the second embodiment cutting mechanism 150 and can be integrated as part of the shaft 302.

Alternative Embodiments and Variations

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

I claim:

1. A method of implementing a handheld tool for procuring kindling, the method comprising:

providing a handheld tool, the handheld tool including:

a handhold having a first end and a second end;

a cutting mechanism disposed proximate the first end, the cutting mechanism defined by:

a depth gauge;

a first top plate having a cutting edge; and a first gullet formed between the depth gauge and the first top plate;

repeatedly scraping a piece of wood with the cutting mechanism of the handheld tool; and procuring scraps of wood formed by the handheld tool;

wherein the cutting edge is parallel with a surface of the piece of wood as the wood is scraped;

wherein a width and a thickness of the second end is tapered towards a face of the second end, the face of the second end including a concave shape.

2. The method of claim 1, wherein the cutting mechanism further includes:

a second top plate having a cutting edge; and a second gullet formed between the first top plate and the second top plate.

3. The method of claim 1, wherein the cutting mechanism is integrated as part of the handhold.

4. The method of claim 1, wherein the cutting mechanism is removably coupled to the handhold.

5. The method of claim 4, wherein the cutting mechanism is at least one cutter link.

6. The method of claim 1, wherein the first top plate extends out perpendicular from a parallel orientation to the depth gauge.

7. The method of claim 1, wherein the cutting mechanism is oriented down at approximately 45 degrees from parallel with a longitudinal axis of the handhold.

8. The method of claim 1, wherein a width and a thickness of the second end of the handhold is tapered.

9. The method of claim 8, wherein the second end is adapted to be a pry bar.

10. The method of claim 1, the method further comprising shaving a ferrocerium rod with the concave face of the second end.

11. The method of claim 1, wherein the concave face of the second end is configured to interact with a ferrocerium rod and create ferrocerium shavings.

12. The method of claim 1, wherein the handhold is a shaft and the second end is coupled to a device.

13. The method of claim 12, wherein the device is a multi-purpose tool.

14. The method of claim 13, wherein the second end is rotatably coupled to the multi-purpose tool.

15. The method of claim 12, wherein the device is a multi-purpose knife.

* * * * *